United States Patent [19]

Burchnell et al.

[11] Patent Number: 5,006,214

[45] Date of Patent: Apr. 9, 1991

[54] CATHODIC PROTECTION APPARATUS

[76] Inventors: Donald H. Burchnell, 7813 Napoleon St.; Donald J. Burchnell, 10607 Allisheim Ave., both of Orlando, Fla. 32825; Joseph R. Burchnell, 2007 Dorris Dr., Orlando, Fla. 32807

[21] Appl. No.: 475,327

[22] Filed: Feb. 5, 1990

[51] Int. Cl.[5] ..... C23F 13/00

[52] U.S. Cl. ..... 204/197; 204/148

[58] Field of Search ..... 204/147, 148, 196, 197, 204/284

[56] References Cited

U.S. PATENT DOCUMENTS

| | | | |
|---|---|---|---|
| 1,705,197 | 3/1929 | Mills | 204/197 |
| 2,101,029 | 12/1937 | Koerber | 204/147 |
| 2,358,981 | 9/1944 | Lattner | 204/197 |
| 2,556,089 | 6/1951 | James et al. | 204/197 |
| 2,846,385 | 8/1958 | Buchan | 204/197 |
| 3,146,182 | 8/1964 | Sabins | 204/197 |
| 3,342,712 | 9/1967 | O'Keefe | 204/197 |
| 3,406,110 | 10/1968 | Turnes et al. | 204/197 |
| 3,445,370 | 5/1969 | Sherman | 204/197 |
| 3,448,034 | 6/1969 | Craft et al. | 204/197 |
| 3,477,930 | 11/1969 | Crites | 204/197 |
| 3,486,999 | 12/1969 | Craft | 204/197 |
| 3,556,971 | 1/1971 | Husock | 204/196 |
| 3,595,774 | 7/1971 | Bremerman | 204/196 |
| 3,794,574 | 2/1974 | Fauth et al. | 204/197 |
| 3,928,155 | 12/1975 | Woodhouse | 204/197 |
| 3,974,071 | 8/1976 | Dunn et al. | 204/197 |
| 4,713,159 | 12/1987 | Truitt et al. | 204/197 |

*Primary Examiner*—T. Tung

*Attorney, Agent, or Firm*—William M. Hobby, III

[57] ABSTRACT

A Cathodic Protection apparatus for water supply pipes and especially for the protection of copper pipes in buildings has a pipe section for inserting into the water line entering a building. A pipe section has a pipe coupling on each end thereof for installing the pipe into the water supply line. A sacrificial anode is supported on a rigid conductor and is held axially aligned in the center of a pipe section by a pair of electrically conductive support brackets. The brackets are attached to the sides of the pipe section by adhesive and an electrically conductive bolt is passed through the pipe section and through the support bracket attached to the pipe section and attaches an electrical ground conductor to the outside of the pipe section for grounding the pipe section. Once attached to a section of a building water supply line, the building copper pipes are protected from corrosion due to electrolytic action.

7 Claims, 1 Drawing Sheet

CATHODIC PROTECTION APPARATUS

BACKGROUND OF THE INVENTION

This invention relates to a cathodic protection device for combating and inhibiting corrosion in copper piping.

Metallic structures installed underground, on the ground, in water, or other wise in contact with an electrolytic medium are subject to corrosion due to a chemical reaction with non-metallic elements in the surrounding medium. The amount or degree of corrosion that takes place may be influenced by several factors such as the type of metal in the structure, the amount of impurities in the metal and the chemical nature of the nonmetallic medium.

When metal corrodes, it replaces hydrogen or another metal from a compound in the surrounding medium. The reactions take place simultaneously on the metal surface. In one reaction metal ions pass into solution and in the other hydrogen ions pass out of solution to form hydrogen gas. Since these two reactions cannot take place at the same point, there must be two kinds of areas on the metal surface: those which are anodic where metal dissolves, and those which are cathodic where hydrogen ions are discharged. Thus, for corrosion to take place a metal structure must have these similar areas, and the interface between a metal and its environment cannot be entirely homogenous. This principle is borne out by the fact that pure, almost perfectly homogeneous, metals have an extremely high resistance to corrosion, even when exposed to highly acidic solutions.

The basis for any electro-chemical treatment of corrosion is the electro-motive force series which is an arrangement of the elements in order of their dissolution tendencies. It must be recognized that this series is dependent on the electrolyte in use at the time of measurement. In other words, it may be said that every solution has its one electro-motive force series.

Water that flows through most piping systems usually have impurities containing various ions, and therefore acts as an electrolyte. Corrosive action may therefore take place on the inside surface of the pipe as described above when any one portion of the metallic pipe structure becomes anodic with respect to another part of the same pipe or with respect to some other object in the surrounding medium. During this electrolytic corrosive action, metal in the anodic areas of the structure is electro-chemically removed, and a weakening and eventually perforation of the piping results. It is well known that corrosive structures can be protected by attaching an expendable material that is anodic with respect to the structure so that material will be dissolved from the sacrificial anode rather than from the structure itself.

It is therefore an aim of my invention to provide an improved Cathodic System particularly adaptable for preventing corrosion in piping systems.

Prior U.S. Patents used in various types of pipe protection systems can be seen in the E. L. James et al, U.S. Pat. No. 2,556,089 for a Cathodic Protection Device in which a magnesium rod is mounted to extend from the pipe entering a hot water heater into the hot water heater. The Truitt et al, U.S. Pat. No. 4,713,159 now has a metal treatment bar in a pipe and the Dunn et al, U.S. Pat. No. 3,974,071 is a water conditioning device in which a scale and inhibiting rod is mounted in a link of pipe The Craft et al U.S. Pat. No. 3,448,034 mounts a stabilizing rod in a well casing as does the R. C. Buchan, U.S. Pat. No. 2,846,385 which prevents corrosion in wells. The H. E. Turnes et al, U.S. Pat. No. 3,406,110 is for a Cathodic Protection of Pipes in a cooling system in which rods are mounted in different positions and pipes are attached to threaded plugs for the insertion or removal of the protective rods. In the U.S. Pat. No. 3,342,712 to a O'Keefe, a water conditioning method has a pipe with a section inserted thereinto which holds a pair of removal sacrificial rods and the whole system is placed within a water line. The Van A. Mills, U.S. Pat. No. 1,705,197 is an electro-chemical means of protecting the interior of pipes from corrosion and has an enlarged pipe section inserted in the pipe line having a treatment portion lining the enlarged pipe section. The Latter U.S. Pat. No. 2,358,981 shows a corrosion preventing device placed in a water line adjacent a boiler The Sherman U.S. Pat. No. 3,445,370 is a corrosion prevention device for irrigation systems in which a Cathodic Device is bolted in a section of an irrigation pipe. The Fauth et al, U.S. Pat. No. 3,794,574 is a device for Cathodically protecting metal conduit systems in which sacrificial rods are placed in a large section of the pipe.

The Present invention is similar to these prior patents in that it uses a sacrificial anode to cathodically protect against pitting in a building's copper pipes by having a copper pipe section which is readily placed in the water line entering the building to form a part of the water line and has an incorporated sacrificial anode axially aligned in the pipe and held by brackets supporting a stiffening conductive rod supporting the sacrificial anodes and allowing one end of the anode to have an improved grounding system.

SUMMARY OF THE INVENTION

A Cathodic Protection apparatus for water supply pipes and especially for the protection of copper pipes in buildings has a pipe section for inserting into the water line entering a building. A pipe section has a pipe coupling on each end thereof for installing the pipe into the water supply line. A sacrificial anode is supported on a rigid conductor and is held axially aligned in the center of a pipe section by a pair of electrically conductive support brackets. The brackets are attached to the sides of the pipe section by adhesive and an electrically conductive bolt is passed through the pipe section and through the support bracket attached to the pipe section and attaches an electrical ground conductor to the outside of the pipe section for grounding the pipe section. Once attached to a section of a building water supply line, the building copper pipes are protected from corrosion due to electrolytic action.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
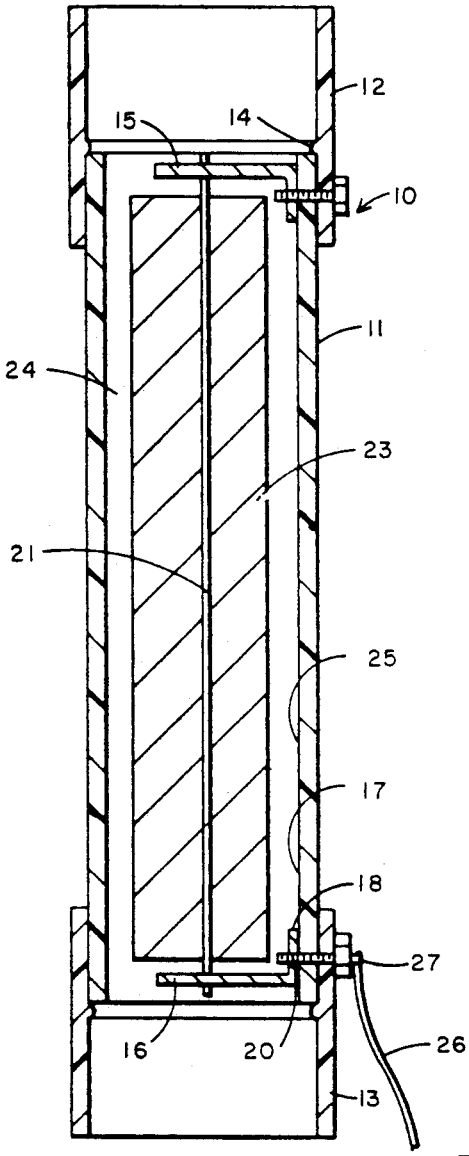
FIG. 1 is a sectional view of a Cathodic Protection Apparatus in accordance with the present invention.
Figure 3:
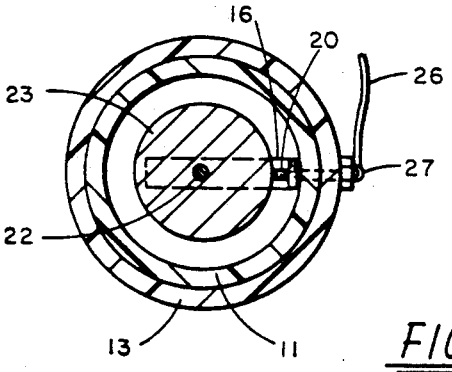
FIG. 3 is a sectional end view of the Cathodic Protection System of FIG. 1.

Referring to the drawings, and especially to FIGS. 1 and 3, a Cathodic Protection Apparatus 10 is illustrated having a polymer section of pipe 11 having a sleeve coupling 12 on one end and a sleeve coupling 13 on the other end thereof. Polymer couplings 12 and 13 are sleeves of a size to fit over the pipe section 11 on one end and over the same size or a different size pipe section on the other end thereof, and may have a small annular ledge 14 therein to stop the pipes half way through the coupling where the pipes are attached thereinto. Pipe section 11 has an electrically conductive bracket 15 on one end and an electrically conductive bracket 16 on the other end which may be copper brackets formed in an L-shape and attached to the internal walls 17 of the pipe section 11, by adhesive at the connection 18. An electrically conductive bolt 20 is bolted through the coupling 13 and through the pipe section 11 and through the conductive bracket 16. An anode support conductor and stiffening rod 21 is attached between the support brackets 15 and 16, such as by passing through an opening 22 in each of the brackets 15 and 16 and being soldered thereto. A sacrificial anode 23 is mounted to the conductive rod 21 and may be a magnesium material formed on a steel or copper wire 21. The anode 23 attached to the rod 21 is mounted in the center of pipe 11 with the brackets 15 and 16 to form an annular passageway 24 between the anode 23 and the inside wall 25 of the pipe section 11.

A heavy electrical conductor ground wire 26 may be a heavy copper wire soldered to a conductive bolt head 27 of the bolt 20 for grounding the bolt 20 and bracket 16 along with the conductive anode support 21 so that small electrical voltages are grounded to the surrounding earth. The plastic pipe section 11 is adhesively attached in the main water line before the water line enters a house or building using the coupling sleeves 12 and 13. The ground 26 is attached into the earth or to a grounding rod planted in the earth. By using this section of pipe to replace a section of pipe in a water line, the entire copper piping within the building has Cathodic protection against electrolytic pitting of the water pipes.

Figure 2:
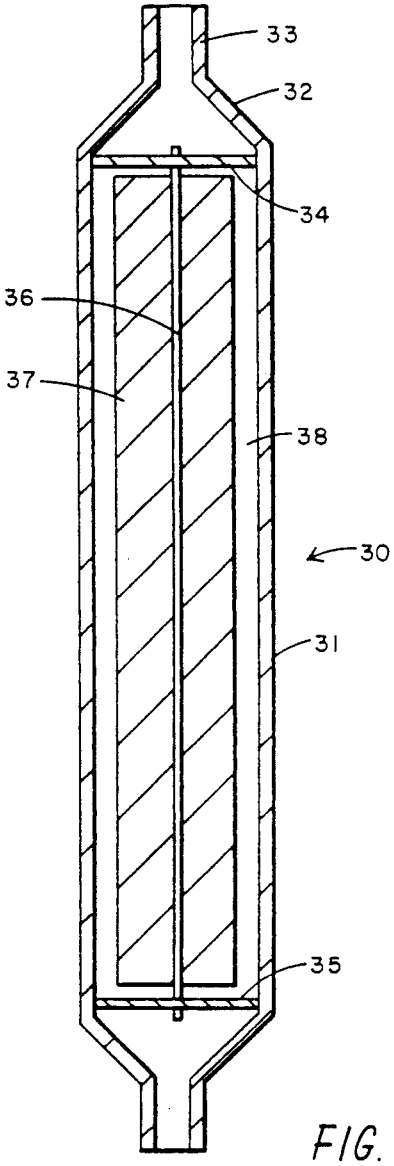
FIG. 2 is a sectional view of a second embodiment of the Cathodic Protection Device of FIG. 1.

FIG. 2 illustrates a slightly modified embodiment of a Cathodic Protection Apparatus 30 in accordance with the present invention of which a copper pipe section 31 has an enlarged pipe section having a narrowing section 32 at each end thereof for connection to a smaller pipe section 33. The pipe section 31 has a pair of conductive brackets 34 and 35 at each end thereof soldered directly into the pipe for mounting the anode support conductor and stiffening rod 36 between the brackets 34 and 35. An enlarged sacrificial anode 37 is mounted to the conductive rod 36. Conductive rod 36 is mounted to each bracket 34 and 35 by passing through the bracket and being soldered or brazed thereto. This allows an enlarged anode 37 to be utilized in a piping system along with an enlarged annular passageway 38 around the anode 37.

It should be clear at this point that a Cathodic System for preventing corrosion in copper water pipes used in buildings has been provided which has a simple attachment to a new or existing water pipe system to protect the water pipes within the building from electrical pitting. This is especially important where polymer pipes, such as PVC (Poly Vinyl Chloride) pipes, are used to bring a water line to a building with copper pipes throughout the buildings. The present invention is not to be construed as limited to the forms shown which are to be considered illustrative rather then restrictive.

We claim:

1. A cathodic protection system for building water supply pipes comprising:

a polymer pipe section;

a polymer pipe coupling on each end of said pipe section for coupling said polymer pipe section in a water supply pipe;

a sacrificial anode formed onto a conductor passing therethrough;

a pair of anode support brackets attached to said pipe section with connection means, said brackets supporting said sacrificial anode conductor at each end thereof to support said sacrificial anode in said pipe section while leaving a passageway between said pipe section and sacrificial anode mounted therein; and a ground wire electrically coupled through said polymer pipe section to one of said anode support brackets and the sacrificial anode grounding said sacrificial anode whereby a building's water pipes are protected from corrosion due to electrolytic action.

2. A cathodic protection system for building water supply pipes in accordance with claim 1 in which said connection means are electrically conductive bolts.

3. A cathodic protection system for building water supply pipes in accordance with claim 2 in which said ground wire is attached to one of said electrically conductive bolts.

4. A cathodic protection system for building water supply pipes in accordance with claim 1 in which said pair of anode support brackets are copper L-shaped brackets.

5. A cathodic protection system for building water supply pipes in accordance with claim 4 in which said sacrificial anode is made of magnesium and said conductor passing therethrough is a copper rod attached thereto.

6. A cathodic protection system for building water supply pipes in accordance with claim 5 in which said pipe coupling is a sleeve adhesively attached to said pipe section.

7. A cathodic protection system for building water supply pipes in accordance with claim 6 in which said sacrificial anode having a conductor passing therethrough is axially aligned in the center of said pipe section to form an annular passageway therearound between said pipe section walls and said sacrificial anode.

* * * * *